US006890247B2

(12) United States Patent
Dehde

(10) Patent No.: US 6,890,247 B2
(45) Date of Patent: May 10, 2005

(54) MANUAL MACHINE-TOOL COMPRISING A BRAKING MEANS

(75) Inventor: Joerg Dehde, Steinenbronn (DE)

(73) Assignee: Robert Bosch GmbH, Stuttgart (DE)

( * ) Notice: Subject to any disclaimer, the term of this patent is extended or adjusted under 35 U.S.C. 154(b) by 205 days.

(21) Appl. No.: 10/333,084

(22) PCT Filed: May 7, 2002

(86) PCT No.: PCT/DE02/01637

§ 371 (c)(1),
(2), (4) Date: Jan. 14, 2003

(87) PCT Pub. No.: WO03/008150

PCT Pub. Date: Jan. 30, 2003

(65) Prior Publication Data

US 2004/0038622 A1 Feb. 26, 2004

(30) Foreign Application Priority Data

Jul. 14, 2001 (DE) ..... 101 34 308

(51) Int. Cl.[7] ..... B24B 27/08
(52) U.S. Cl. ..... 451/359; 451/357
(58) Field of Search ..... 451/359, 357

(56) References Cited

U.S. PATENT DOCUMENTS

| | | | | | |
|---|---|---|---|---|---|
| 5,392,568 | A | * | 2/1995 | Howard et al. | 451/357 |
| 5,496,207 | A | * | 3/1996 | Hornung et al. | 451/357 |
| 5,679,066 | A | * | 10/1997 | Butz et al. | 451/357 |
| 5,807,169 | A | * | 9/1998 | Martin et al. | 451/357 |
| 5,813,903 | A | * | 9/1998 | Amano et al. | 451/294 |
| 6,132,300 | A | * | 10/2000 | Martin | 451/357 |
| 6,264,539 | B1 | * | 7/2001 | Chen | 451/359 |

FOREIGN PATENT DOCUMENTS

| | | |
|---|---|---|
| DE | 36 42 741 A | 6/1988 |
| DE | 199 52 108 A | 5/2001 |

* cited by examiner

*Primary Examiner*—Eileen P. Morgan
(74) *Attorney, Agent, or Firm*—Michael J. Striker

(57) ABSTRACT

The invention is based on a hand power tool, in particular a disk-type sander, that comprises a motor (12) with a drive shaft (14) located in a housing, whereby the drive shaft (14)—by way of its side furthest from the motor (12)—is joined via an eccentric (18) with a sanding disk (16) that can walk around an annular, turnably supported means (20, 72) that is capable of being braked via braking means (22, 62).

It is proposed that the annular means (20, 72) are supported in the braking means (22, 62).

11 Claims, 3 Drawing Sheets

MANUAL MACHINE-TOOL COMPRISING A BRAKING MEANS

BACKGROUND OF THE INVENTION

The invention is based on a hand power tool according to the preamble of claim 1.

A hand power tool, in particular a motor-driven off-hand grinder, is made known in DE 199 52 108 A1, that comprises a motor with a drive shaft located in a housing. The drive shaft—by way of its side furthest from the motor—is joined via an eccentric sleeve with a sanding disk. Formed on the sanding disk—which is supported on the eccentric sleeve via a first bearing eccentrically relative to the drive shaft—is a first annular means that comprises a first, radially outwardly facing rolling face. A second annular means having a radially inwardly facing, second rolling face corresponding with the first rolling face is turnably supported on the eccentric sleeve via a second bearing coaxially in relation to the center axis of the drive shaft of the motor.

The second means is enclosed—over part of its area—by an elastic band that forms a braking means. The second annular means are capable of being fixed in position in torsion-resistant fashion via the braking means for a forced drive or for a rotating drive of the sanding disk that superposes an orbital motion. The first rolling face of the first annular means can walk around the second rolling face of the second annular means, which leads to a rotary motion of the sanding disk. If the braking means are released, the second means can be rotated, and a forced drive is stopped.

ADVANTAGES OF THE INVENTION

The invention is based on a hand power tool, in particular a disk-type sander, that comprises a motor with a drive shaft located in a housing, whereby the drive shaft—by way of its side furthest from the motor—is joined via an eccentric with a sanding disk that can walk around an annular, turnably supported means that is capable of being braked via braking means.

It is proposed that the annular means are supported in the braking means. Advantageously, components—in particular bearing components—and installation space can be spared, and a robust, cost-effective device can be obtained that is compact in design, in the axial direction in particular. Moreover, an encapsulated design having inboard rubbing surfaces can be realized, by way of which said rubbing surfaces can be protected against contamination, in particular against sanding dust.

If, during operation, an operator lifts the hand power tool away from a surface of a material to be worked, the sanding disk can reach a high rate of rotational speed due to the friction prevailing in a sanding disk bearing and the absence of friction between the sanding disk and the material. If the annular means have a permanent, active connection with the sanding disk, the sanding disk can be advantageously prevented from racing by means of forced rubbing between the annular means and the braking means. A separate component for reducing rotational speed, in particular a rubber lip joined with the housing in torsion-resistant fashion, can be avoided. Additional rubbing on the sanding disk and additional loading of the sanding disk resulting therefrom can be prevented.

If the annular means has teeth, around which the sanding disk can walk via corresponding teeth, a secure, slip-free connection can be advantageously obtained with high efficiency. The connection between the annular means and the sanding disk can also be designed as a friction connection or a connection having undefined teeth, however.

If the annular means is formed by a belt, a cost-effective standard component can be used that has low weight. If the belt is made of rubber, a high amount of friction can be obtained with only slight contact force. The belt can also be formed out of other components and/or other materials that appear reasonable to one skilled in the art, such as plastic, aluminum, etc. If the annular means is formed by a gear made of aluminum, frictional heat can be dissipated via the annular means in particularly advantageous fashion.

If the cross-section of the annular means is designed trapezoidal in shape, a large contact surface can be obtained between the braking means and the annular means, with which the torque occurring between the annular means and the braking means can be advantageously transferred. Moreover, an advantageous means of guiding the annular means in the braking means can be obtained.

It is feasible, in principle, that the annular means and the braking means are used solely to prevent the sanding disk from racing. Particularly advantageously, however, torque acting between the annular means and the braking means can be adjusted via a switching device. If the annular means is arrested in the braking means in torsion-resistant fashion, a forced drive can be obtained, and the sanding disk can walk around the annular means. By means of the walking-around motion, an orbital motion of the sanding disk supported eccentrically relative to the motor shaft can be combined with a rotary motion of the sanding disk, and a motion of the sanding disk can be obtained with which a high level of abrasion on the material to be worked can be achieved. If the set torque is exceeded, a slipping of the annular means in the braking means can be achieved, and an overloading of the motor—in particular when the sanding disk is obstructed—can be advantageously prevented. If the braking means are open and the annular means are turnably supported in the braking means, a free-running operation of the sanding disk can be obtained, and a particularly fine working of a surface can be achieved.

If the braking means are loaded via at least one spring element, a steady-state application of the torque acting on the annular means can be achieved, and, in fact, when the spring element acts in the closing direction of the braking means, or a reliable opening of the braking means can be achieved when the spring element acts in the opening direction of the braking means. If the spring element acts in the closing direction, wear between the annular means and the braking means can be compensated. If the spring element acts in the opening direction of the braking means, a reliable opening of the braking means and operation with low material abrasion can always be ensured. The spring element can be formed by a separate component, e.g., by a tension-loaded or compression-loaded helical compression spring, etc., or it can be designed integral with the braking means, e.g., by forming the braking means out of spring steel.

In a further embodiment of the invention, it is proposed that braking action is produced by means of a force acting on the braking means in the axial direction, by way of which the annular means can be reliably prevented from jamming in the braking means. Moreover, cost-effective braking means and annular means having simple cross-sectional geometries can be achieved.

The braking means can be designed as a single component or having two components. If the braking means are designed with at least two components, a particularly simple assembly can be obtained, whereby the braking means can be divided into various layers appearing reasonable to one skilled in the art.

It is further proposed that the braking means comprises at least two jaws capable of pivoting around a pivot axis. An even load applied by the braking means to the annular means can be advantgeously achieved using simple design means.

Particularly advantageously, the pivot axis is located on a side opposite from the switching device. A large lever arm can be obtained, via which the annular means can be arrested in the braking means via a switching device using a small amount of force, and the hand power tool can be switched into the forced-drive mode with a small amount of force. The jaws can be integrally interconnected in the region of the pivot axis, or they can be designed separate in the region of the pivot axis, e.g., in that they are held together via a joint shell integral with the housing.

SUMMARY OF THE DRAWINGS

Further advantages result from the description of the drawing hereinbelow. The drawings, the description, and the claims contain numerous features in combination. One skilled in the art will advantageously consider them individually as well and combine them into reasonable further combinations.

DESCRIPTION OF THE PREFERRED EMBODIMENTS

Figure 1:
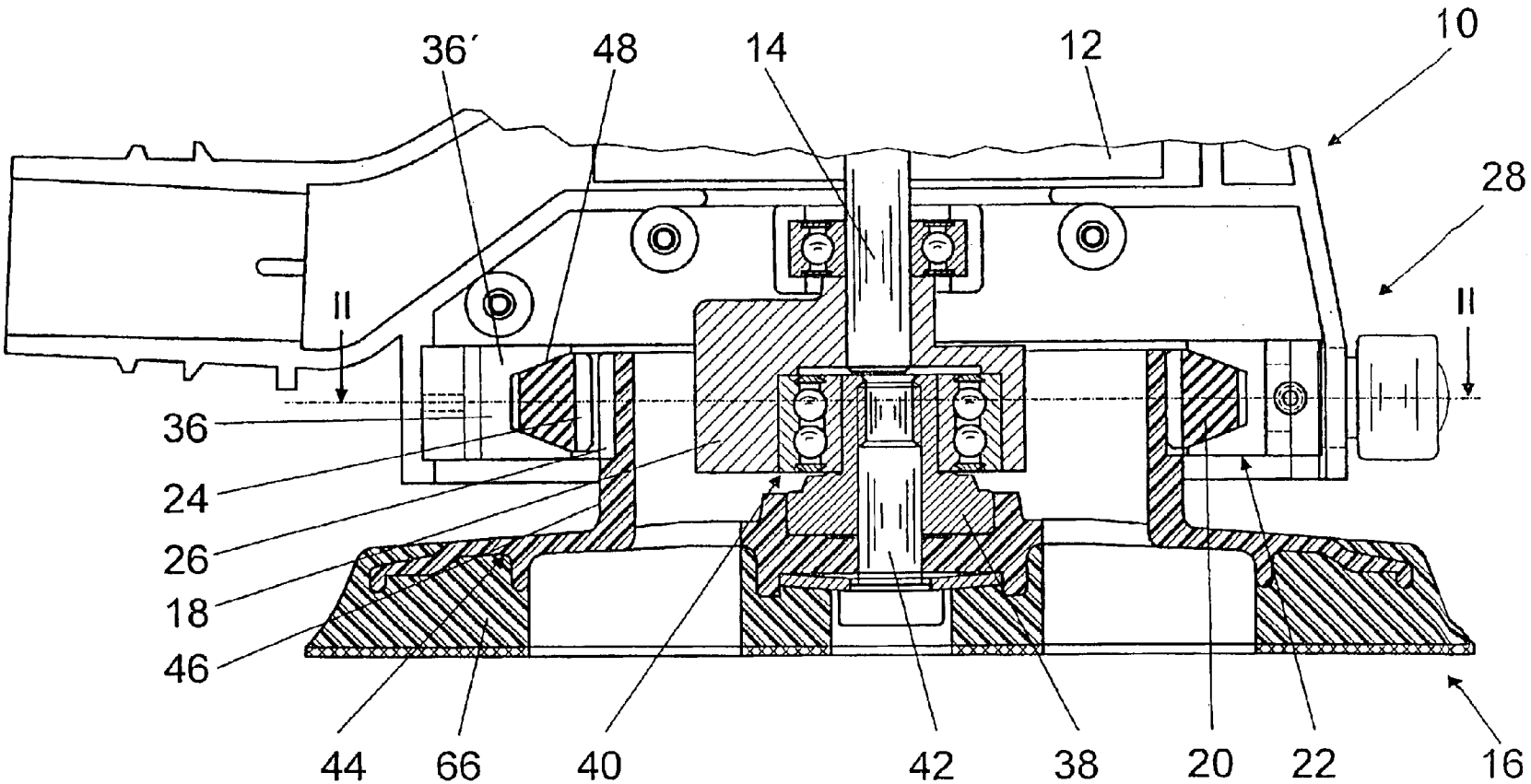
FIG. 1 shows a partial sectional drawing through a disk-type sander.

FIG. 1 shows a partial sectional drawing of a disk-type sander having an electric motor 12—located in a housing 10—with a drive shaft 14. On the side furthest from the electric motor 12, the drive shaft 14 is joined with a sanding disk 16 via an eccentric 18. The sanding disk 16 is turnably supported in the eccentric 18 eccentrically relative to the drive shaft 14 via a journal 38 and a sanding disk bearing 40, and it is securely joined with the journal 38 via a screw 42.

On its side closest to the electric motor 12, the sanding disk 16 comprises a sanding pad carrier 44 holding a sanding pad 66 with a flange 46 facing the electric motor 12 in the axial direction (FIG. 1). On its radially outwardly facing side, the flange 46 has teeth 26 that mesh in corresponding, radially inwardly facing teeth 24 of an annular means 20, and said flange has a permanent, active connection with the annular means 20.

Figure 2:
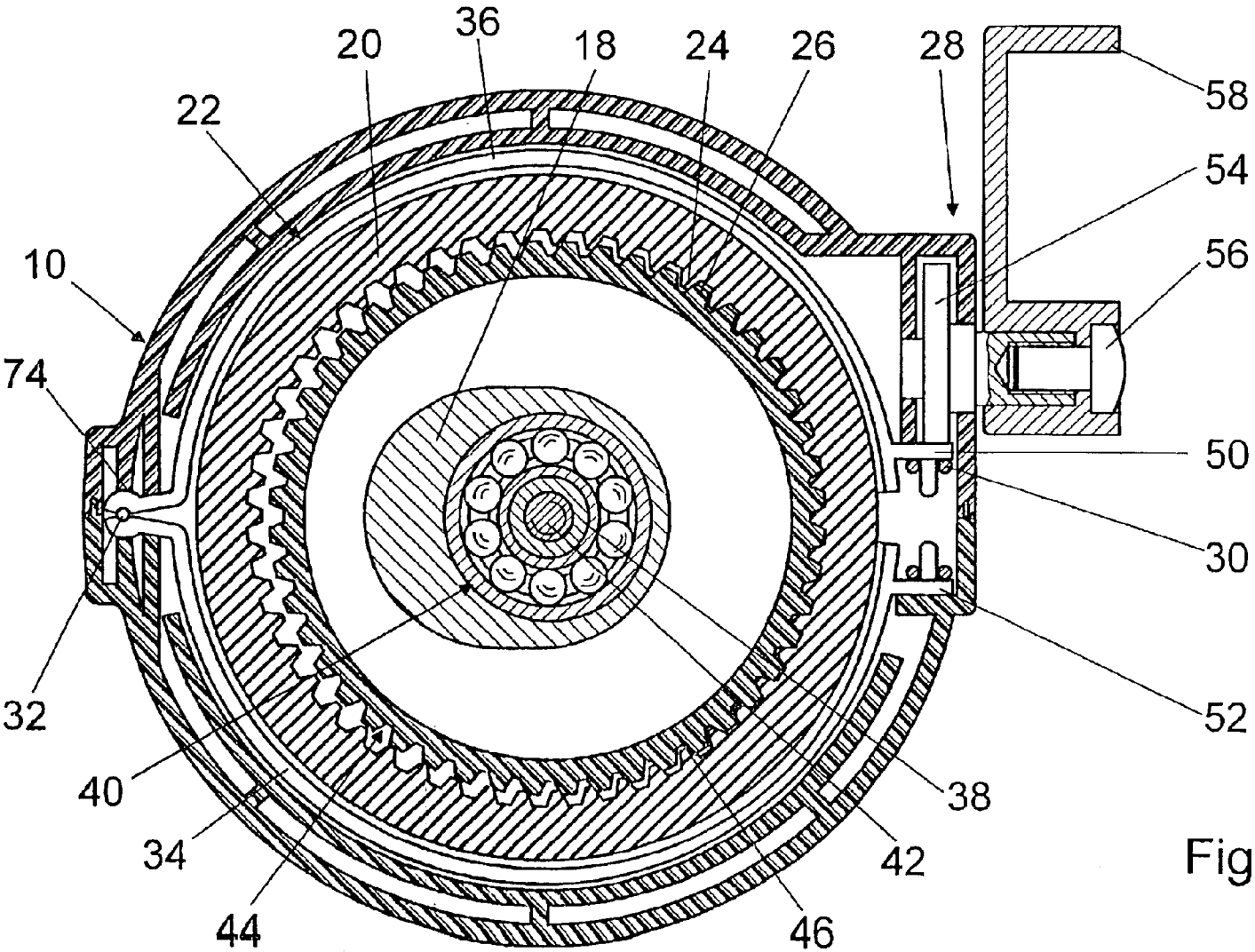
FIG. 2 shows a sectional drawing along the line II—II in FIG. 1.

The annular means 20 formed by a rubber belt has a trapezoidal cross-section and is turnably supported in a recess 48—having a trapezoidal cross-section—of a basically annular braking means 22 (FIGS. 1 and 2). The braking means 22—supported in the housing 10 in torsion-resistant fashion concentrically with the drive shaft 14—nearly completely surrounds the rubber belt 20 in its circumferential direction. The braking means 22 have a first unit facing away from the sanding disk 16, and a second unit facing the sanding disk 16, whereby each of the units is divided into two jaws 34, 36 designed semicircular in shape.

The jaws 34, 36 are supported in a joint shell 74 integral with the housing 10 in a fashion that allows them to pivot around a pivot axis 32. On the side opposite from the pivot axis 32, the jaws 34, 36 are joined via a switching device 28 (FIG. 2).

On the side closest to the switching device 28, a first projection 50 extending in the radial direction is integrally molded on jaw 36, and a second projection 52 extending in the radial direction is integrally molded on jaw 34 (FIG. 2). An external side of the first projection 50 has an active connection with an eccentric 54 of the switching device 28, while an external side of the second projection 52 bears against the housing 10. A compression-loaded helical compression spring 30 bears, with its ends, against the opposing internal sides of projections 50, 52 and loads the braking means 22 in its opening direction.

The eccentric 54 is joined via a screw 56 with a lever 58 of the switching device 28 (FIG. 2). Torque acting between the rubber belt 20 and the braking means 22 can be adjusted on the braking means 22 by an operator via the lever 58 and the eccentric 54 of the switching device 28.

If the disk-type sander is in its free-running mode, the helical compression spring 30 presses—via the projections 50, 52—the braking means 22 so far apart that the rubber belt 20 is turnably supported in the recess 48 in nearly frictionless fashion. Residual friction remaining between the braking means 22 and the rubber belt 20 prevents an undesired racing of the sanding disk 16 when, during operation, said sanding disk is lifted away from a surface to be worked.

If the operator actuates the lever 58, the braking means 22 are loaded via the eccentric 54 against a spring force of the helical compression spring 30, and, in fact, until the rubber belt 20 is held in the braking means 22 in torsion-resistant fashion, which brings about a forced drive. With forced drive, the eccentrically supported sanding disk 16, with its teeth 26, can walk around the teeth 24 of the rubber belt 20 supported concentrically and in torsion-resistant fashion in the braking means 22 at a constant rotational speed. In addition to the orbital motion of the sanding disk 16, said sanding disk also executes a rotary motion by walking around the rubber belt 20.

Figure 3:
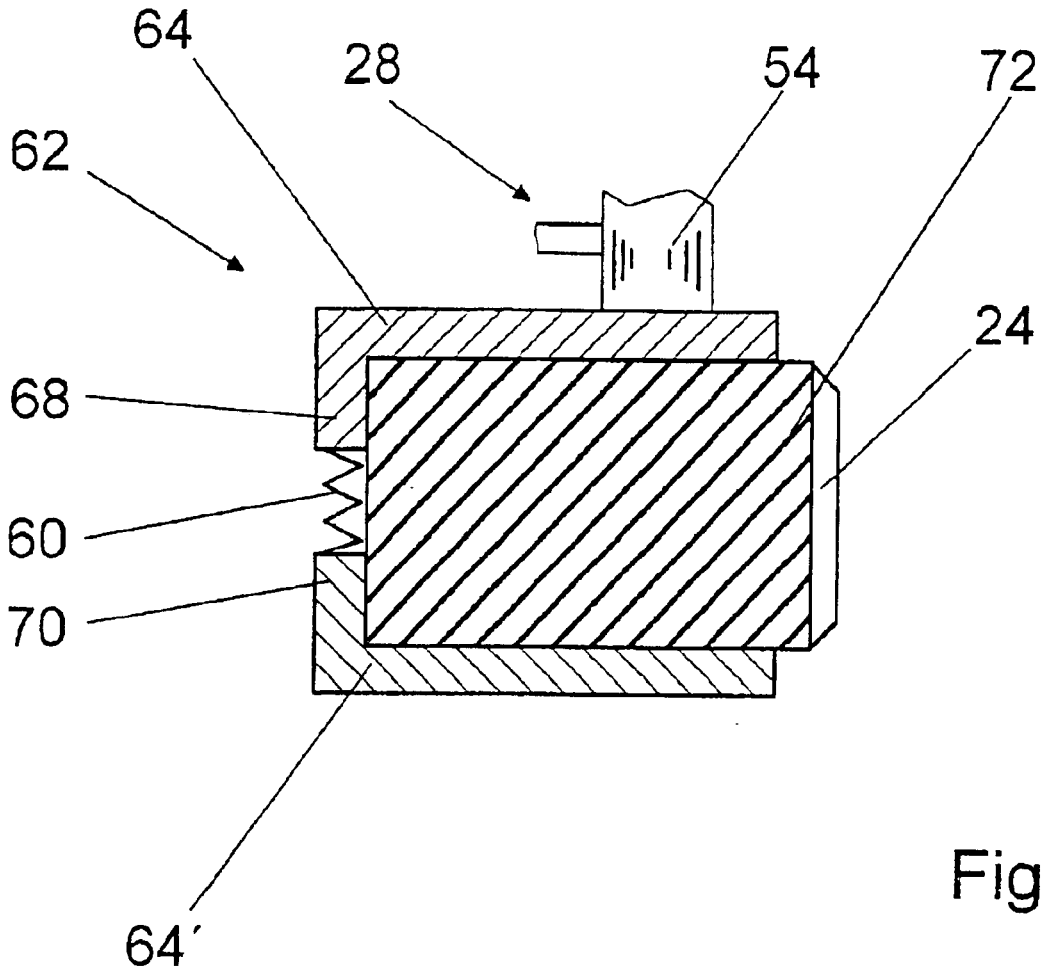
FIG. 3 shows a section of an alternative braking means.

FIG. 3 shows a braking device 62 as an alternative to FIGS. 1 and 2. Components that essentially remain the same are labelled with the same reference numerals. Moreover, the description of the exemplary embodiment shown in FIGS. 1 and 2 can be referred to with regard for features and functions that remain the same. The description below is basically limited to the differences from the exemplary embodiment shown in FIGS. 1 and 2.

The braking means 62—divided in the axial direction into a first unit facing away from the sanding disk and a second unit facing the sanding disk—can be loaded via a switching device 28 in the axial direction to produce braking action. Each of the units has a semicircular jaw 64, 64', each of which has a collar 68, 70 in the radially outer region facing the other unit, whereby a rubber ring 72 having an essentially rectangular cross-section is guided in the radial direction through the collars 68, 70. A plurality of helical compression springs 60 is distributed around the circumference in the axial direction between the collars 68, 70, which said helical compression springs load the braking means 62 in its opening direction. Jaw 64 is capable of being adjusted in the axial direction via an eccentric 54.

Jaws 64, 64' could also be adjusted in the axial direction via other devices appearing reasonable to one skilled in the art, e.g., via threads, etc. Instead of numerous helical compression springs 60, a wave disk spring could be used as well, which wave disk spring could be located between one of the two semicircular jaws 64, 64' and the rubber ring 72. The wave disk spring could compensate for tolerances and wear between the individual components.

| Reference Numerals | |
|---|---|
| 10 | Housing |
| 12 | Motor |
| 14 | Drive shaft |
| 16 | Sanding disk |
| 18 | Eccentric |
| 20 | Means |
| 22 | Braking means |
| 24 | Teeth |
| 26 | Teeth |
| 28 | Switching device |
| 30 | Spring element |
| 32 | Pivot axis |
| 34 | Jaw |
| 36 | Jaw |
| 38 | Journal |
| 40 | Sanding disk bearing |
| 42 | Screw |
| 44 | Sanding pad carrier |
| 46 | Flange |
| 48 | Recess |
| 50 | Projection |
| 52 | Projection |
| 54 | Eccentric |
| 56 | Screw |
| 58 | Lever |
| 60 | Spring element |
| 62 | Braking means |
| 64 | Jaw |
| 66 | Sanding pad |
| 68 | Collar |
| 70 | Collar |
| 72 | Means |
| 74 | Joint shell |

What is claimed is:

1. A hand power tool in the form of an eccentric disk grinder, comprising a motor (12) with a drive shaft (14) located in a housing (10), whereby the drive shaft (14) is joined via an eccentric (18) end with a sanding disk (16), the eccentric end (18) of the drive shaft (14) facing away from said motor (12), said sanding disk (16) being movable on rolling contact inside an annular means (20, 72), said annular means (20, 72) being rotatably supported in said housing (10), said annular means (20, 72) being further capable of being braked via braking means (22, 62) connected to said housing (10), whereby the annular means (20, 72) is rotatably supported in said housing (10) via the braking means (22, 62).

2. The hand power tool according to claim 1, wherein the annular means (20, 72) has a permanent, active connection with the sanding disk (16).

3. The hand power tool according to claim 1, wherein the annular means (20, 72) comprise teeth (24) around which the sanding disk (16) is moveable via corresponding teeth (26).

4. The hand power tool according to claim 1, wherein the annular means (20, 72) is in the form of a belt.

5. The hand power tool according to claim 1, wherein the cross-section of the annular means (20) is trapezoidal in shape.

6. The hand power tool according to claim 1, wherein torque acting between the annular means (20, 72) and the braking means (22, 62) can be adjusted by means of a switching device (28).

7. The hand power tool according to claim 1, wherein the braking means (22, 62) is tensioned via at least one spring element (30, 60).

8. The hand power tool according to claim 1, wherein braking action is produced by a force acting on the braking means (62) in an axial direction of the braking means.

9. The hand power tool according to claim 1, wherein the braking means (22, 62) has at least two components.

10. The hand power tool according to claim 1, wherein the braking means (22, 62) comprise at least two jaws (34, 36) capable of being pivoted around a pivot axis (32).

11. The hand power tool according to claim 6, wherein the pivot axis (32) is located opposite from the switching device (28).

* * * * *